US012173407B2

(12) United States Patent
Smith et al.

(10) Patent No.: US 12,173,407 B2
(45) Date of Patent: Dec. 24, 2024

(54) CORROSION PROTECTION WITH Al/Zn-BASED COATINGS

(71) Applicant: Bluescope Steel Limited, Melbourne (AU)

(72) Inventors: Ross McDowall Smith, Cordeaux Heights (AU); Qiyang Liu, Mount Keira (AU); Bryan Andrew Shedden, Albion Park (AU); Aaron Kiffer Neufeld, Figtree (AU); Joe Williams, Woonona (AU); David James Nolan, Gerringong (AU); Wayne Renshaw, Unanderra (AU)

(73) Assignee: Bluescope Steel Limited, Melbourne (AU)

( * ) Notice: Subject to any disclaimer, the term of this patent is extended or adjusted under 35 U.S.C. 154(b) by 0 days.

(21) Appl. No.: 18/366,827

(22) Filed: Aug. 8, 2023

(65) Prior Publication Data

US 2024/0076769 A1 Mar. 7, 2024

Related U.S. Application Data

(63) Continuation of application No. 17/966,157, filed on Oct. 14, 2022, now Pat. No. 11,807,941, which is a (Continued)

(30) Foreign Application Priority Data

Mar. 13, 2009 (AU) ..... 2009901083

(51) Int. Cl.

| | |
|---|---|
| ***C23C 2/12*** | (2006.01) |
| ***C23C 2/06*** | (2006.01) |
| ***C23C 2/14*** | (2006.01) |

(52) U.S. Cl.

CPC ..... *C23C 2/12* (2013.01); *C23C 2/06* (2013.01); *C23C 2/14* (2013.01); *Y10T 428/12021* (2015.01); *Y10T 428/12028* (2015.01)

(58) Field of Classification Search

CPC .... C23C 2/12; C23C 2/06; C23C 2/14; C23C 2/20

See application file for complete search history.

(56) References Cited

U.S. PATENT DOCUMENTS 3,343,930 A 9/1967 Borzillo et al.
3,782,909 A 1/1974 Cleary et al.
(Continued)

FOREIGN PATENT DOCUMENTS

EP 0028821 A1 5/1981
EP 0545049 A1 6/1993
(Continued)

OTHER PUBLICATIONS

ASTM International, "Standard Specification for Steel Sheet, 55% Aluminum-Zinc Alloy-Coated by the Hot-Dip Process," 2009, 7 pages.

(Continued)

*Primary Examiner* — Hai Y Zhang
(74) *Attorney, Agent, or Firm* — Sterne, Kessler, Goldstein & Fox P.L.L.C.

(57) ABSTRACT

Red rust staining of Al/Zn coated steel strip in "acid rain" or "polluted" environments can be minimised by forming the coating as an Al—Zn—Si—Mg alloy coating with an OT:S-DAS ratio greater than a value of 0.5:1, where OT is the overlay thickness on a surface of the strip and SDAS is the measure of the secondary dendrite arm spacing for the Al-rich alpha phase dendrites in the coating. Red rust staining in "acid rain" or "polluted" environments and (Continued)

corrosion at cut edges in marine environments can be minimised in Al—Zn—Si—Mg alloy coatings on steel strip by selection of the composition (principally Mg and Si) and solidification control (principally by cooling rate) and forming $Mg_2Si$ phase particles of a particular morphology in interdendritic channels.

9 Claims, 7 Drawing Sheets

Related U.S. Application Data continuation of application No. 17/015,208, filed on Sep. 9, 2020, now Pat. No. 11,512,377, which is a continuation of application No. 13/255,965, filed as application No. PCT/AU2010/000285 on Mar. 12, 2010, now abandoned.

(56) References Cited

U.S. PATENT DOCUMENTS

| | | | | |
|---|---|---|---|---|
| 4,401,727 | A | 8/1983 | Berke et al. | |
| 4,412,870 | A | 11/1983 | Vernam et al. | |
| 5,141,781 | A | 8/1992 | Suzuki et al. | |
| 5,360,641 | A | 11/1994 | Tu | |
| 5,571,327 | A | 11/1996 | Ookouchi et al. | |
| 6,610,422 | B1 | 8/2003 | Ooi et al. | |
| 6,635,359 | B1 * | 10/2003 | Kurosaki | C23C 2/12 428/653 |
| 6,689,489 | B2 | 2/2004 | McDevitt | |
| 8,293,376 | B2 | 10/2012 | Liu et al. | |
| 11,512,377 | B2 | 11/2022 | Smith et al. | |
| 2003/0152796 | A1 * | 8/2003 | Clancy | C23C 2/26 428/626 |
| 2006/0057417 | A1 | 3/2006 | Tada et al. | |
| 2006/0177687 | A1 * | 8/2006 | Renshaw | C23C 2/06 428/653 |

FOREIGN PATENT DOCUMENTS

| | | | |
|---|---|---|---|
| EP | 1199376 | A1 | 4/2002 |
| EP | 1489195 | A1 | 12/2004 |
| EP | 1557478 | A1 | 7/2005 |
| EP | 3757245 | A1 | 12/2020 |
| GB | 2243843 | A | 11/1991 |
| JP | S5956570 | A | 4/1984 |
| JP | 1279767 | | 10/1989 |
| JP | 6020228 | | 3/1993 |
| JP | H06279889 | A | 10/1994 |
| JP | H10152765 | A | 6/1998 |
| JP | H11343555 | A | 12/1999 |
| JP | H11343599 | A | 12/1999 |
| JP | 2000104153 | A | 4/2000 |
| JP | 2000328214 | A | 11/2000 |
| JP | 2001089838 | A | 4/2001 |
| JP | 2001115247 | A | 4/2001 |
| JP | 2001316791 | A | 11/2001 |
| JP | 2001323357 | A | 11/2001 |
| JP | 2001355055 | A | 12/2001 |
| JP | 2002012959 | A | 1/2002 |
| JP | 2002129300 | A | 5/2002 |
| JP | 2002285310 | A | 10/2002 |
| JP | 2002322527 | A | 11/2002 |
| JP | 2002332555 | A | 11/2002 |
| JP | 2002348649 | A | 12/2002 |
| JP | 2002363722 | A | 12/2002 |
| JP | 2002371344 | A | 12/2002 |
| JP | 2003277906 | A | 10/2003 |
| JP | 2003328506 | A | 11/2003 |
| JP | 2004238682 | A | 8/2004 |
| JP | 2005015907 | A | 1/2005 |
| JP | 2005036304 | A | 2/2005 |
| JP | 2005133151 | A | 5/2005 |
| JP | 2005264188 | A | 9/2005 |
| JP | 2006022409 | A | 1/2006 |
| JP | 2007284718 | A | 11/2007 |
| JP | 2011514935 | A | 5/2011 |
| KR | 20040058492 | A | 7/2004 |
| WO | WO-2001011100 | A1 | 2/2001 |
| WO | WO-2001027343 | A1 | 4/2001 |
| WO | WO-2004083480 | A1 | 9/2004 |
| WO | WO-2006070995 | A1 | 7/2006 |
| WO | WO-2006105593 | A1 | 10/2006 |
| WO | WO-2007134400 | A1 | 11/2007 |
| WO | WO-2008025066 | A1 | 3/2008 |
| WO | WO-2008141398 | A1 | 11/2008 |
| WO | WO-2009111843 | A1 | 9/2009 |
| WO | WO-2010102343 | A1 | 9/2010 |

OTHER PUBLICATIONS

Australian Standard, Methods for the Determination of Grain Size in Metals, AS 1733-1976, p. 1-5, 1976.

European Patent Office Notice of Opposition for Application No. 10750246.0 dated Jul. 16, 2021 (23 pages).

Hosking et al., "Corrosion resistance of zinc-magnesium coated steel", Corrosion Science, 2007, vol. 49, pp. 3669-3695.

International Search Report for Application No. PCT/AU2010000285, dated May 10, 2010 (4 pages).

GalvInfo Center—A Program of the International Zinc Association, Chapter 2.4.1: "Zinc Bath Management on Continuous Hot-Dip Galvanizing Lines," 6 pages, International Zinc Association, Durham, NC (2009).

Luo, Q., et al., "The Mechanism of Dross Formation during Hot-dip Al-Zn Alloy Coating Process," Journal for Manufacturing Science & Production 13(1-2):85-89, Walter De Gruyter, GmbH (2013).

Phelan, D., et al., "Formation of Intermetallic Phases on 55 wt. % Al-Zn-Si hot dip strip," Materials Science and Engineering A 420:144-149, Elsevier, Netherlands (2006).

DIN EN 10346:2009-07, "Continuously hot-dip coated steel flat products—Technical Delivery Conditions," DIN Deutsches Institut. Für Normung, English version, 41 pages (Jul. 2009).

Stahl-Informations-Zentrum, Arbeitskreis Organisch Beschichtetes Blech Und Band Im Fachausschuss Für Feinblech "Zinc-Magnesium Coated Stell Sheets—Less is More," Stahl-Informations-Zentrum, Düsseldorf, Germany, English version, 20 pages (2013 Edition).

* cited by examiner

Fig.5A
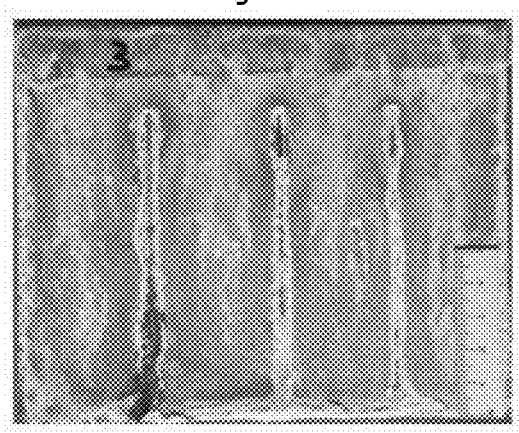
Fig.5B
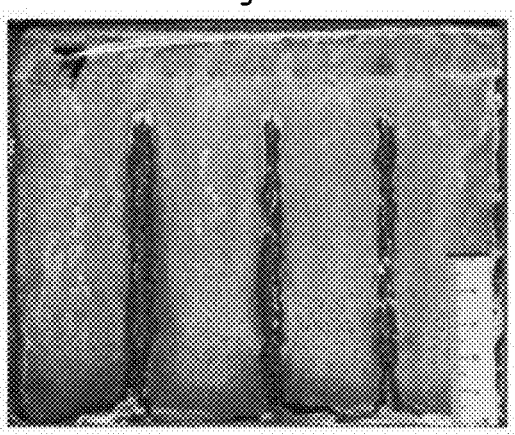
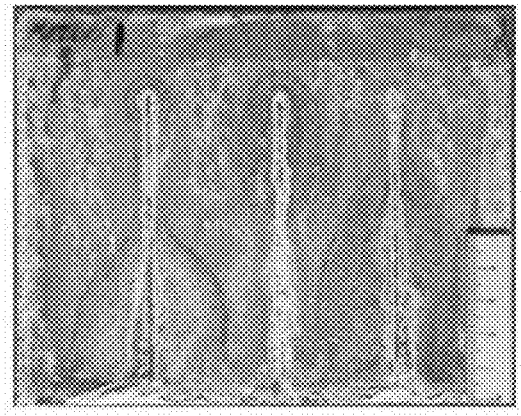
Fig.5C
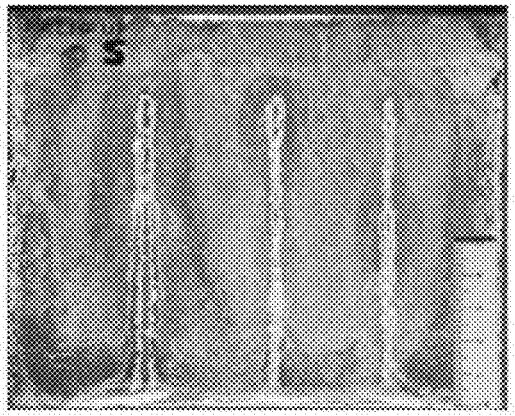
Fig.5D

CORROSION PROTECTION WITH Al/Zn-BASED COATINGS

TECHNICAL FIELD

The present invention relates generally to the production of products that have a coating of an alloy containing aluminium and zinc as the main components of the alloy (hereinafter referred to as "Al/Zn-based alloy coated products").

The term "Al/Zn-based alloy coated products" is understood herein to include products, by way of example, in the form of strip, tubes, and structural sections, that have a coating of an Al/Zn-based alloy on at least a part of the surface of the products.

The present invention relates more particularly, although by no means exclusively, to Al/Zn-based alloy coated products in the form of a metal, such as steel, strip having an Al/Zn-based alloy coating on at least one surface of the strip and products made from Al/Zn-based alloy coated strip.

The Al/Zn-based alloy coated metal strip may be strip that is also coated with inorganic and/or organic compounds for protective, aesthetic or other reasons.

The present invention relates more particularly, although by no means exclusively, to Al/Zn-based alloy coated steel strip that has a coating of an alloy of more than one element other that Al and Zn, such as Mg and Si, in more than trace amounts.

The present invention relates more particularly, although by no means exclusively, to Al/Zn-based alloy coated steel strip that has a coating of an Al/Zn-based alloy containing Mg and Si with 20-95% Al, up to 5% Si, up to 10% Mg and balance Zn with other elements in small amounts, typically less than 0.5% for each other element, with all percentages being percentages by weight. It is noted that unless otherwise specifically mentioned, all references to percentages of elements in the specification are references to percentages by weight.

BACKGROUND ART

Thin (i.e. 2-100 μm thick) Al/Zn-based alloy coatings are often formed on the surfaces of steel strip to provide protection against corrosion.

The Al/Zn-based alloy coatings are generally, but not exclusively, coatings of alloys of elements Al and Zn and one or more of Mg, Si, Fe, Mn, Ni, Sn and other elements such as V, Sr, Ca, Sb in small amounts.

The Al/Zn-based alloy coatings are generally, but not exclusively, formed on steel strip by hot dip coating strip by passing strip through a bath of molten alloy. The steel strip is typically, but not necessarily exclusively, heated prior to dipping to promote bonding of the alloy to the strip. The alloy subsequently solidifies on the strip and forms a solidified alloy coating as the strip emerges from the molten bath.

The Al/Zn-based alloy coatings typically have a microstructure consisting predominantly of an Al-rich alpha phase in the form of dendrites and a Zn-rich eutectic phase mixture in the region between the dendrites. When the solidification rate of the molten coatings is suitably controlled (for example, as described in U.S. Pat. No. 3,782,909, incorporated herein by cross-reference), the Al-rich alpha phase solidifies as dendrites that are sufficiently fine that they define a continuous network of channels in the interdendritic region, and the Zn-rich eutectic phase mixture solidifies in this region.

The performance of these coatings relies on a combination of (a) sacrificial protection of the steel base, initially by the Zn-rich interdendritic eutectic phase mixture and (b) barrier protection by the supporting Al-rich alpha phase dendrites. The Zn-rich interdendritic phase mixture corrodes preferentially to provide sacrificial protection of the steel substrate and, in certain environments, the Al-rich alpha phase can also continue to provide a suitable level of sacrificial protection to the steel substrate, as well as barrier protection, once the Zn-rich interdendritic phase mixture has been exhausted.

There are, however, many circumstances where the level of barrier protection and sacrificial protection afforded by the Al-rich alpha phase dendrites is insufficient and performance of the coated steel strip may suffer. Three such areas are as follows.

1. In "acid rain" or "polluted" environments containing high concentrations of nitrogen oxides and sulfur oxides.
2. Under paint films in marine environments.
3. At cut edges or other areas where the metallic coating has been damaged to expose the steel substrate in marine environments.

By way of example, the applicant has found that when Al/Zn-based alloy coatings on steel strip are particularly thin (i.e. coatings having a total coating mass of less than 200, typically less than 150, g per $m^2$ of coating, which equates to less than 100, typically less than 75, g per $m^2$ of coating on each surface of a steel strip when there are equal coating thicknesses on both surfaces), the microstructure trends to a more columnar or bamboo structure extending from the steel strip to the coating surface when the coating is formed with standard cooling rates, typically from 11° C./s to 100° C./s. This microstructure comprises (a) Al-rich alpha phase dendrites and (b) a Zn-rich eutectic phase mixture forming as a series of separate columnar channels that extend directly from the steel strip to the coating surface.

The applicant has also found that when steel strip having such thin Al/Zn-based alloy coatings with a columnar microstructure is exposed to low pH environments, commonly described as "acid-rain" environments, or exposed to environments that have high concentrations of sulfur dioxide and nitrogen oxides, commonly described as "polluted" environments, the Zn-rich interdendritic eutectic phase mixture is quickly attacked and the columnar channels of this phase mixture that extend directly from the steel strip to the coating surface act as direct corrosion paths to the steel strip. Where there are such direct corrosion paths from the coating surface to the steel strip, the steel strip is likely to corrode and the corrosion products (oxides of iron) can travel freely to the coating surface and develop an appearance known as "red rust staining". Red rust staining degrades the aesthetic appearance of a coated steel product and can decrease performance of the products. For example, red rust staining can reduce the thermal efficiency of coated steel products that are used as roofing materials.

The applicant has also found that where the thin Al/Zn-based coating is damaged to reveal the steel strip by scratching, cracking or other means, and exposed to "acid-rain" environments, or "polluted" environments, red rust staining can occur even in the absence of a columnar or bamboo structure.

It is also known that in an "acid rain" environment or a "polluted" environment the Al-rich alpha phase is unable to sacrificially protect the steel strip.

An "acid rain" environment is understood herein to be an environment where the rain and/or condensation forming on a coated steel strip has a pH of less than 5.6. By way of example, a "polluted environment" can be typically, but by no means exclusively, defined as a P2 or P3 category in ISO9223.

Also by way of example, in marine environments, where Al-rich alpha phase dendrites are normally considered to provide good sacrificial protection to a steel substrate, this ability is diminished by changes in the micro-environment beneath paint films applied over the metallic coated steel strip.

The above description is not to be taken as an admission of the common general knowledge in Australia or elsewhere.

SUMMARY OF INVENTION

The applicant has found that red rust staining of Al/Zn-based alloy coated steel strip in "acid rain" or "polluted" environments can be prevented or minimised by forming the coating as an Al—Zn—Si—Mg alloy coating and ensuring that the OT:SDAS ratio of the coating is greater than a value of 0.5:1, where OT is the overlay thickness on a surface of the strip and SDAS is the measure of the secondary dendrite arm spacing for the Al-rich alpha phase dendrites in the coating.

The term "overlay thickness" is understood herein to mean the total thickness of the coating on the strip minus the thickness of the intermetallic alloy layer of the coating, where the intermetallic alloy layer is an Al—Fe—Si—Zn quaternary intermetallic phase layer immediately adjacent to the steel substrate that forms by the reaction between the molten coating and the steel substrate when the coating is applied to the strip.

According to the present invention there is provided a method for forming a coating of a corrosion resistant Al—Zn—Si—Mg alloy on a metal, typically steel, strip, that is suitable, by way of example, for "acid rain" or "polluted" environments comprises:

(a) passing metal strip through a molten bath of the Al—Zn—Si—Mg alloy and forming a coating of the alloy on one or both surfaces of the strip, (b) solidifying the coating on the strip and forming a solidified coating having a microstructure that comprises dendrites of Al-rich alpha phase and interdendritic channels of Zn-rich eutectic phase mixture, extending from the metal strip, and with particles of $Mg_2Si$ phase in the interdendritic channels, and the method comprising controlling steps (a) and (b) and forming the solidified coating with an OT:SDAS ratio greater than 0.5:1, where OT is the overlay thickness and SDAS is the secondary dendrite arm spacing for the Al-rich alpha phase dendrites of the coating.

The term "Zn-rich eutectic phase mixture" is understood herein to mean a mixture of products of eutectic reactions, with the mixture containing Zn-rich β phase and Mg:Zn compound phases, for example, $MgZn_2$.

According to the present invention there is also provided a metal strip with a coating of an Al—Zn—Si—Mg alloy on one or both surfaces of the strip that is suitable, by way of example, for "acid rain" or "polluted" environments, with the coating comprising a microstructure that comprises dendrites of Al-rich alpha phase and interdendritic channels of Zn-rich eutectic phase mixture extending from the metal strip, and with particles of $Mg_2Si$ phase in the interdendritic channels, and the coating having an OT:SDAS ratio greater than 0.5:1, where OT is the overlay thickness and SDAS is the secondary dendrite arm spacing for the Al-rich alpha phase dendrites of the coating.

It is noted that, where the coating is on both surfaces of the strip, the overlay thickness on each surface may be different or the same, depending on the requirements for the coated strip. In any event, the invention requires that the OT:SDAS ratio be greater than 0.5:1 for the coating on each of the two surfaces.

The OT:SDAS ratio may be greater than 1:1.

The OT:SDAS ratio may be greater than 2:1.

The coating may be a thin coating.

In this context, a "thin" coating on a metal, such as a steel, strip is understood herein to mean a coating having a total coating mass of less than 200 g per $m^2$ coating on both surfaces of the strip, which equates to less than 100 g per $m^2$ coating on one surface of the steel strip, which may not always be the case.

The overlay thickness of the coating may be greater than 3 μm.

The overlay thickness of the coating may be less than 20 μm.

The overlay thickness of the coating may be less than 30 μm.

The overlay thickness of the coating may be 5-20 μm.

The Al—Zn—Si—Mg alloy may contain 20-95% Al, up to 5% Si, up to 10% Mg and balance Zn with other elements in small amounts, typically less than 0.5% for each other element.

The Al—Zn—Si—Mg alloy may contain 40-65% Al.

The Al—Zn—Si—Mg alloy may contain 45-60% Al.

The Al—Zn—Si—Mg alloy may contain 35-50% Zn.

The Al—Zn—Si—Mg alloy may contain 39-48% Zn.

The Al—Zn—Si—Mg alloy may contain 1-3% Si.

The Al—Zn—Si—Mg alloy may contain 1.3-2.5% Si.

The Al—Zn—Si—Mg alloy may contain less than 5% Mg.

The Al—Zn—Si—Mg alloy may contain less than 3% Mg.

The Al—Zn—Si—Mg alloy may contain more than 1% Mg.

The Al—Zn—Si—Mg alloy may contain 1.2-2.8% Mg.

The Al—Zn—Si—Mg alloy may contain 1.5-2.5% Mg.

The Al—Zn—Si—Mg alloy may contain 1.7-2.3% Mg.

The metal strip may be a steel strip.

In addition or in the event that the above-described OT:SDAS ratio cannot be maintained and the coatings have OT:SDAS ratios of less than 0.5:1, the applicant has also found that red rust staining in "acid rain" or "polluted" environments and also corrosion at cut edges in marine environments can be prevented or minimised in thin Al—Zn—Si—Mg alloy coatings on steel strip by selection of the composition (principally Mg and Si) of the coating alloy and control of the microstructure of the coating.

The above-described composition selection and microstructure control is particularly useful for thin coatings and/or coatings with an OT:SDAS ratio less than 0.5:1, but is not restricted to these coatings and also applies to thick coatings and/or coatings with an OT:SDAS ratio greater than 0.5:1.

The applicant has also found that corrosion at cut edges of coated steel strip in marine environments and red rust staining in "acid rain" or "polluted" environments can be eliminated or minimised in susceptible Al/Zn-based coatings by:

1. Blocking corrosion along the Zn-rich interdendritic channels to the steel strip, and/or
2. Rendering the Al-rich alpha phase active in these environments so that it can sacrificially protect the steel strip.

In general terms, in both cases, according to the present invention there is provided a metal strip with a coating of an Al—Zn—Si—Mg alloy on one or both surfaces of the strip that is suitable, by way of example, for "acid rain" or "polluted" environments, with the coating comprising a microstructure that comprises dendrites of Al-rich alpha phase and interdendritic channels of Zn-rich eutectic phase mixture extending from the metal strip, and with particles of $Mg_2Si$ phase in the interdendritic channels.

The term "particles" is understood herein in the context of $Mg_2Si$ phase to be an indication of the physical form of the precipitates of this phase in the microstructure. It is understood herein that the "particles" form via precipitation from solution during solidification of a coating and are not specific particular additions to the composition.

BRIEF DESCRIPTION OF THE DRAWINGS

FIG. 5A shows a photograph of laboratory accelerated test panel for a 150 g/m$^2$ Al/Zn Coating, DAS=9 μm/OT: DAS=2, Time to 5% red rust on un-scribed surface=2435 hr.

FIG. 5B shows a photograph of laboratory accelerated test panel for a 150 g/m$^2$ Al/Zn Coating, DAS=4 μm/OT: DAS=5, Time to 5% red rust on un-scribed surface=3024 hr.

FIG. 5C shows a photograph of laboratory accelerated test panel for a 150 g/m$^2$ Invention Coating, DAS=8 μm/OT: DAS=2.5, Time to 5% red rust on un-scribed surface=3192 hr.

FIG. 5D shows a photograph of laboratory accelerated test panel for a 150 g/m$^2$ Invention Coating DAS=3 μm/OT: DAS=6, Time to 5% red rust on un-scribed surface=4000 hr.

1. Blocking

Figure 1:
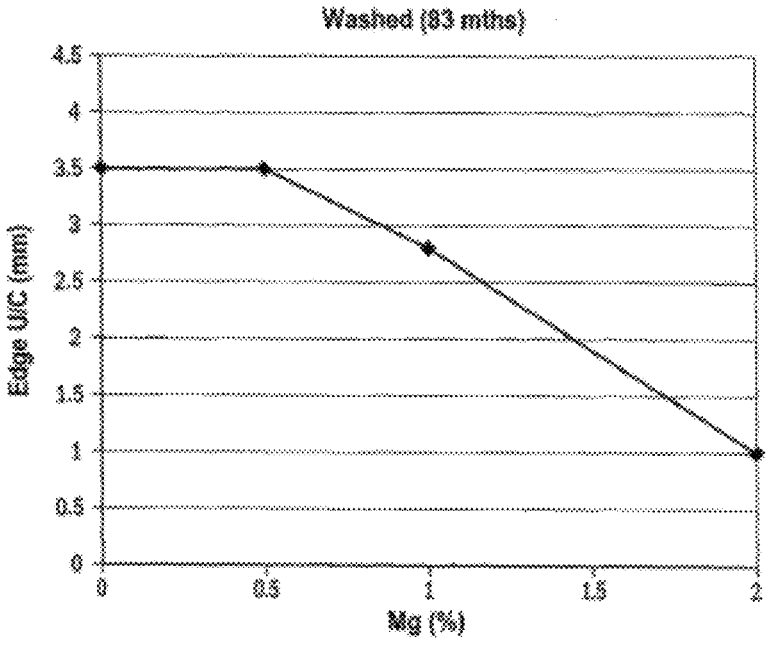
FIG. 1 is a graph of edge undercutting and Mg concentration in examples of Al—Zn—Si—Mg alloy coatings in accordance with the invention on test samples in marine environments.

According to the present invention there is provided a method for forming a coating of a corrosion resistant Al—Zn—Si—Mg alloy on a metal, typically steel, strip, that is suitable, by way of example, for "acid rain" or "polluted" environments comprises:

(a) passing metal strip through a molten bath of the Al—Zn—Si—Mg alloy and forming a coating of the alloy on one or both surfaces of the strip, (b) solidifying the coating on the strip and forming a solidified coating having a microstructure that comprises dendrites of Al-rich alpha phase and interdendritic channels of Zn-rich eutectic phase mixture, extending from the metal strip, and with $Mg_2Si$ phase in the interdendritic channels, and the method comprising selecting the Mg and Si concentrations and controlling the cooling rate in step (b) to form particles of $Mg_2Si$ phase in the interdendritic channels in the solidified coating that block corrosion along the interdendritic channels.

By way of explanation, in Al/Zn-based coatings with a dendritic structure, Si is present as particles with a flake-like morphology and, although it does not corrode, it does not fill and block the interdendritic channels from interdendritic corrosion to the steel strip. The applicant has found that Mg added to Al/Zn-based coatings containing Si can combine with Si to form $Mg_2Si$ phase particles in the interdendritic channels between the arms of the Al-rich alpha phase dendrites that have an appropriate size and morphology which block what would otherwise be direct corrosion pathways to the steel strip and helps to isolate the underlying steel substrate cathode. The appropriate size and morphology particles are formed by controlling solidification, i.e. cooling rate, of the coating.

In particular, the applicant has found that the cooling rate CR during coating solidification should be maintained less than 170-4.5CT, where CR is the cooling rate in ° C./second and CT is the coating thickness on a surface of the strip in micrometres.

The morphology of the appropriately sized $Mg_2Si$ phase particles may be described as being in the form of "Chinese script" when viewed in planar images and as being in the form of flower petals when viewed in 3-dimensional images. The morphology is shown, by way of example, in FIGS. 12 and 13 and discussed further below.

The petals of the $Mg_2Si$ particles may have a thickness less than 8 μm.

The petals of the $Mg_2Si$ phase particles may have a thickness less than 5 μm.

The petals of the $Mg_2Si$ phase particles may have a thickness in a range of 0.5-2.5 μm.

The Mg concentration may be selected to be greater than 0.5%. Below this concentration there are insufficient $Mg_2Si$ phase particles to fill and block interdendritic channels.

The Mg concentration may be selected to be less than 3%. Above this concentration large $Mg_2Si$ particles with a cube-type morphology form that are ineffective at blocking interdendritic corrosion.

In particular, the Al—Zn—Si—Mg alloy may contain more than 1% Mg.

For coatings with Si concentrations from 0.5 to 2%, the volume fraction of interdendritic $Mg_2Si$ phase compared to other Si-containing phases may be greater than 50%.

The volume fraction of interdendritic $Mg_2Si$ phase compared to other Si-containing phases may be greater than 80%.

The proportion of interdendritic $Mg_2Si$ phase situated in the lower two thirds of the overlay thickness of the coating may be greater than 70% of the total volume fraction of $Mg_2Si$ phase in the coating in order to provide good blocking of interdendritic channels.

The proportion of interdendritic channels "blocked" by $Mg_2Si$ phase may be greater than 60%, typically greater than 70%, of the total number of channels.

The applicant has also found that the improved protection that is possible with the present invention applies across a range of microstructures, from coarse dendrite structures with OT:SDAS ratios of 0.5:1 to fine dendrite structures with OT:SDAS ratios of 6:1.

Corrosion along these pathways in general, and red rust staining via these pathways in particular, in "acid rain" or "polluted" environments is therefore retarded.

In Al/Zn alloy coatings, corrosion along the interdendritic channels may also be restricted by reducing the size of the channels as a consequence of increasing the cooling rate during solidification and thereby reducing the SDAS of the coating, as disclosed in U.S. Pat. No. 3,782,909. However, while this may slow surface corrosion of the coating (as often determined by mass loss testing), it restricts the availability of the zinc rich phases mixture to provide sacrificial protection for the steel substrate. Consequently, corrosion of the steel substrate occurs more readily.

2. Activation of Alpha Phase

According to the present invention there is provided a method for forming a coating of a corrosion resistant Al—Zn—Si—Mg alloy on a metal, typically steel, strip, that is suitable, by way of example, for "acid rain" or "polluted" environments comprises:

(a) passing metal strip through a molten bath of the Al—Zn—Si—Mg alloy and forming a coating of the alloy on one or both surfaces of the strip, (b) solidifying the coating on the strip and forming a solidified coating having a microstructure that comprises dendrites of Al-rich alpha phase and interdendritic channels of Zn-rich eutectic phase mixture, extending from the metal strip, and with $Mg_2Si$ phase in the interdendritic channels, and the method comprising selecting the Mg and Si concentrations and controlling the cooling rate in step (b) to form particles of $Mg_2Si$ phase in the interdendritic channels in the solidified coating having a size range, morphology and a spacial distribution that activates the Al-rich alpha phase to provide sacrificial protection.

In particular, the applicant has found that $Mg_2Si$ phase by itself is reactive and can corrode readily. However, the applicant has also found conditions that render the $Mg_2Si$ phase passive, enable channel blocking and promote, and enhance activation of the Al-rich alpha phase in the sacrificial protection of the steel strip.

In particular, the applicant has found that the addition of suitable Mg and Si concentrations to Al/Zn-based alloy coating compositions and the selection of the cooling rate to solidify a coating of the alloy composition on a steel strip can result in the formation of a $Mg_2Si$ phase in a suitable dispersion and location in interdendritic channels to activate Al-rich alpha phase to provide sacrificial protection of the steel in certain marine and "acid rain" and "polluted" environments.

Activation of the Al-rich alpha phase enables the application of finer dendritic structures without the consequent loss of sacrificial protection ability at cut edges or other regions where the steel substrate has been exposed.

The selection of Mg and Si concentrations and the cooling rate is in line with the description of these parameters under the heading "Blocking".

Specifically, in the case of cooling rate, the applicant has found that the cooling rate CR during coating solidification should be maintained less than 170-4.5CT, where CR is the cooling rate in ° C./second and CT is the coating thickness on a surface of the strip in micrometres.

In the case of composition, by way of example, in "acid rain" or "polluted" environments and "acid" micro-environments, the Mg concentration may be greater than 0.5% for the formation of $Mg_2Si$.

The Mg concentration may be greater than 1% to ensure effective activation of the alpha phase.

The Mg concentration may be less than 3%. At higher concentrations coarse, widely dispersed primary $Mg_2Si$ phase can form which cannot provide uniform activation of the Al-rich alpha phase.

In particular, the Al—Zn—Si—Mg alloy may contain more than 1% Mg.

The applicant has also found that the improved sacrificial protection that is possible with the present invention applies across a range of microstructures, from coarse dendrite structures with OT:SDAS ratios of 0.5:1 to fine dendrite structures with OT:SDAS ratios of 6:1.

The applicant has also found that Al—Zn—Si—Mg alloy coated strip manufactured in accordance with the present invention, and subsequently painted, shows the development of a more narrow, uniform corrosion front as a result of Al-rich alpha phase activation and a reduced level of edge undercutting in marine environments.

Samples manufactured in accordance with the present invention showed a reduced rate of "edge creep" or "undercutting" from cut-edges, compared to conventional Al/Zn coatings, in experimental work carried out by the applicant.

The improved performance has been shown to apply to a range of coating structures and for a range of paint films.

Figure 2:
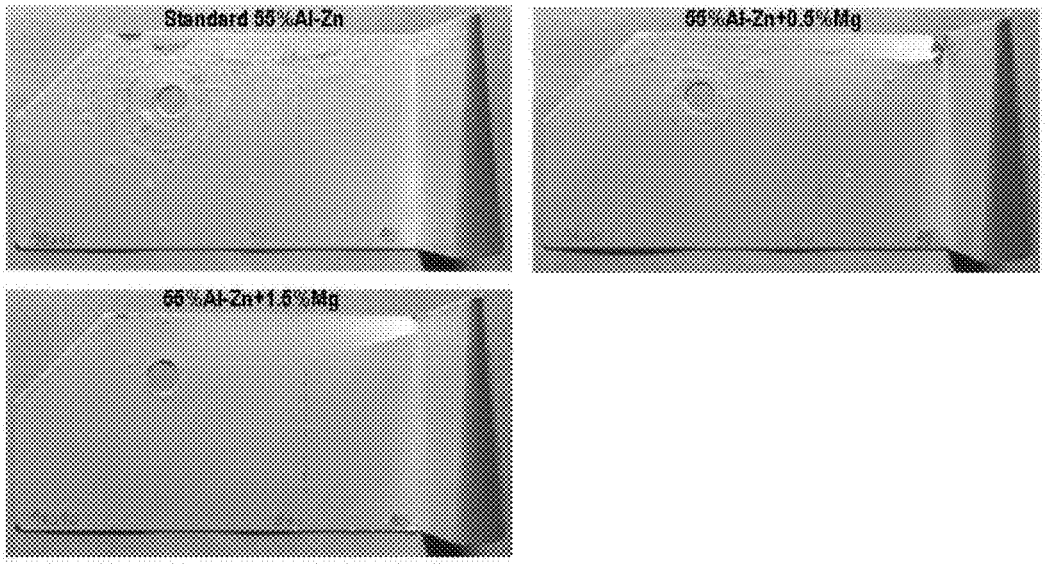
FIG. 2 shows photographs of test panels showing improved corrosion performance for fluorocarbon painted, metallic coated steel strip in accordance with the present invention, for unwashed exposure in a severe marine environment.
Figure 3:
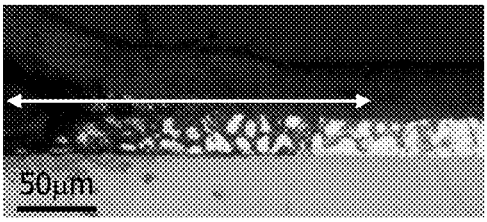
FIG. 3 shows a micrograph of the extensive corrosion front for a conventional Al/Zn coating under paint in a marine environment.
Figure 4:
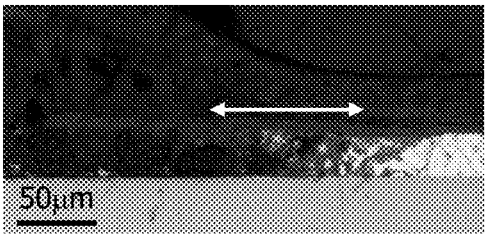
FIG. 4 shows a micrograph of the more narrow and uniform corrosion front for metallic coated steel strip in accordance with the present invention, under paint in a marine environment.
Figure 6:
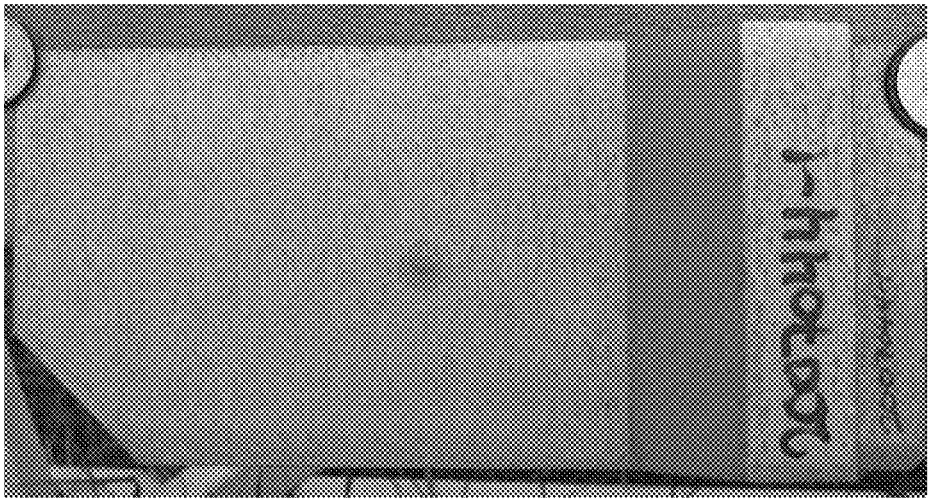
FIG. 6 shows a photograph of red rust staining on a conventional Al/Zn-based coated steel strip (total coating mass of 100 g/m$^2$ of coating), exposed in a severe "acid rain" environment for 6 months.
Figure 7:
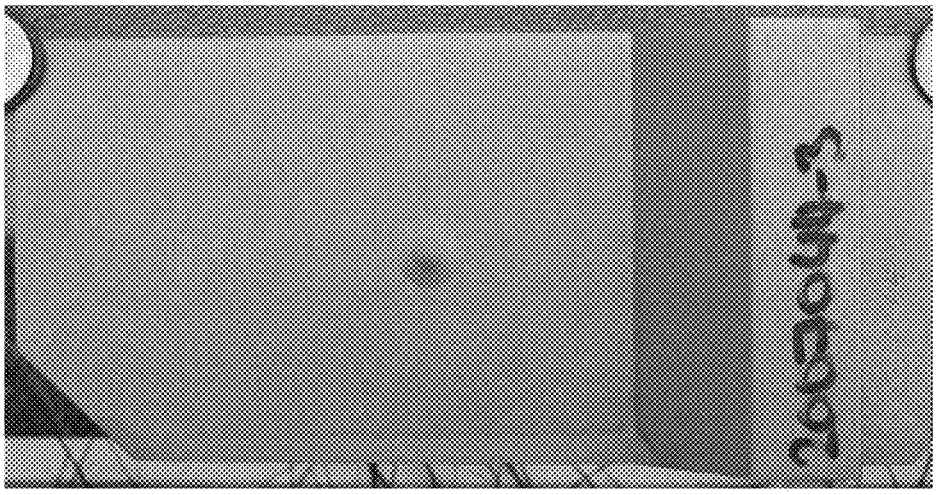
FIG. 7 shows a photograph of no red rust staining on the Al/Zn metallic coated steel strip in accordance with the present invention (total coating mass of 100 g/m$^2$ of coating), exposed in a severe "acid rain" environment for 6 months.
Figure 8:
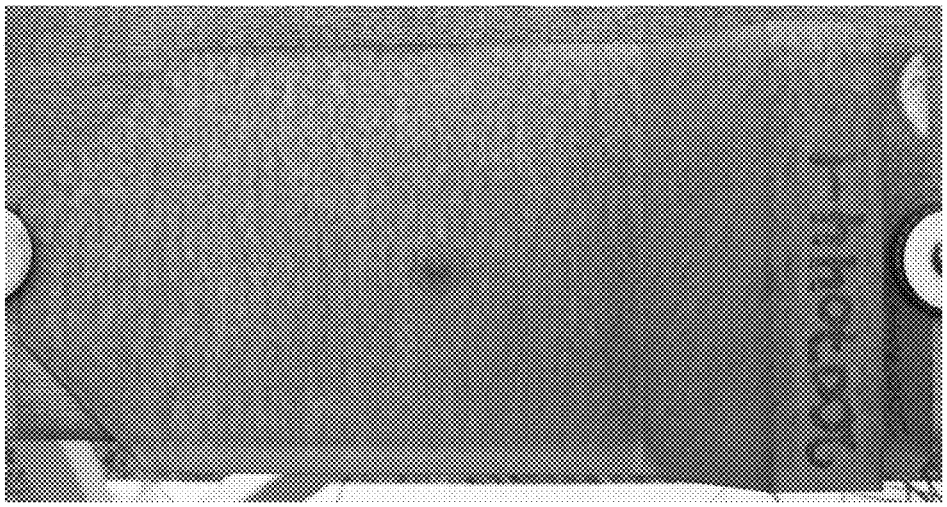
FIG. 8 shows a photograph of red rust staining on a conventional Al/Zn-based coated steel strip (total coating mass of 100 g/m$^2$ of coating), exposed in a severe "acid rain" environment for 18 months.
Figure 9:
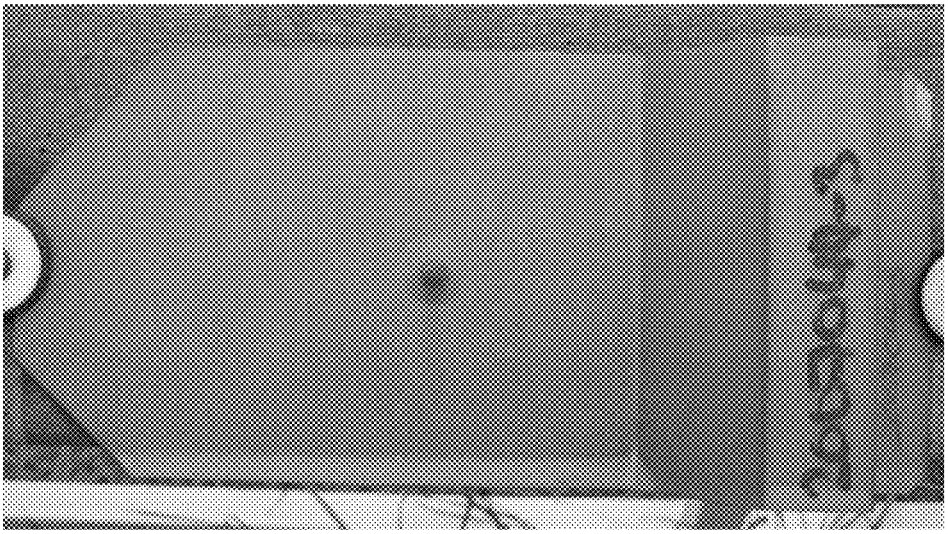
FIG. 9 shows a photograph of no red rust staining on the Al/Zn metallic coated steel strip in accordance with the present invention (total coating mass of 100 g/m$^2$ of coating), exposed in a severe "acid rain" environment for 18 months.
Figure 10:
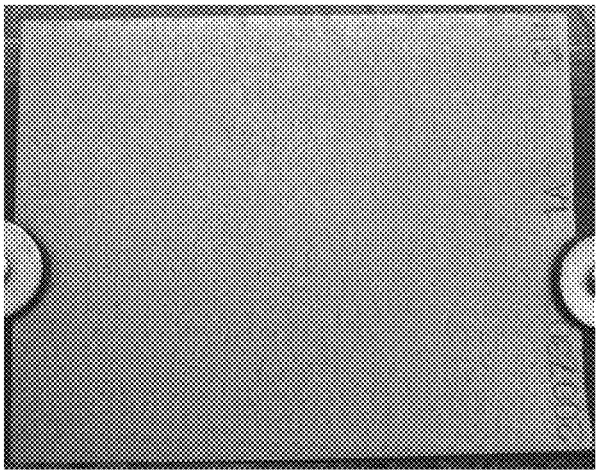
FIG. 10 shows a photograph of red rust staining on a conventional Al/Zn-based coated steel strip with columnar structure (total coating mass of 50 g/m$^2$ of coating), exposed in a severe "acid rain" environment for 4 months.
Figure 11:
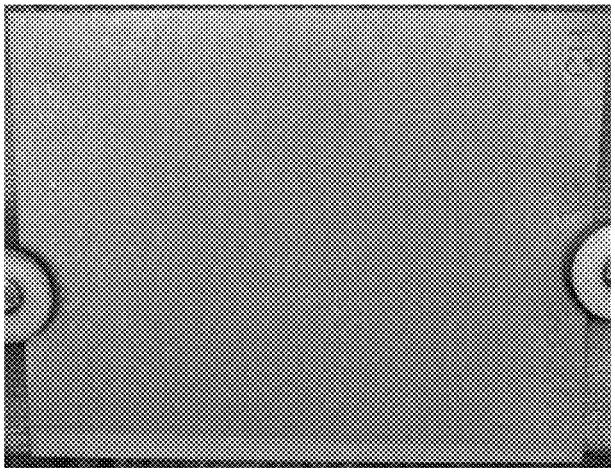
FIG. 11 shows a photograph of no red rust staining on the Al/Zn metallic coated steel strip in accordance with the present invention, with columnar structure (total coating mass of 50 g/m$^2$ of coating), exposed in a severe "acid rain" environment for 4 months.
Figure 12:
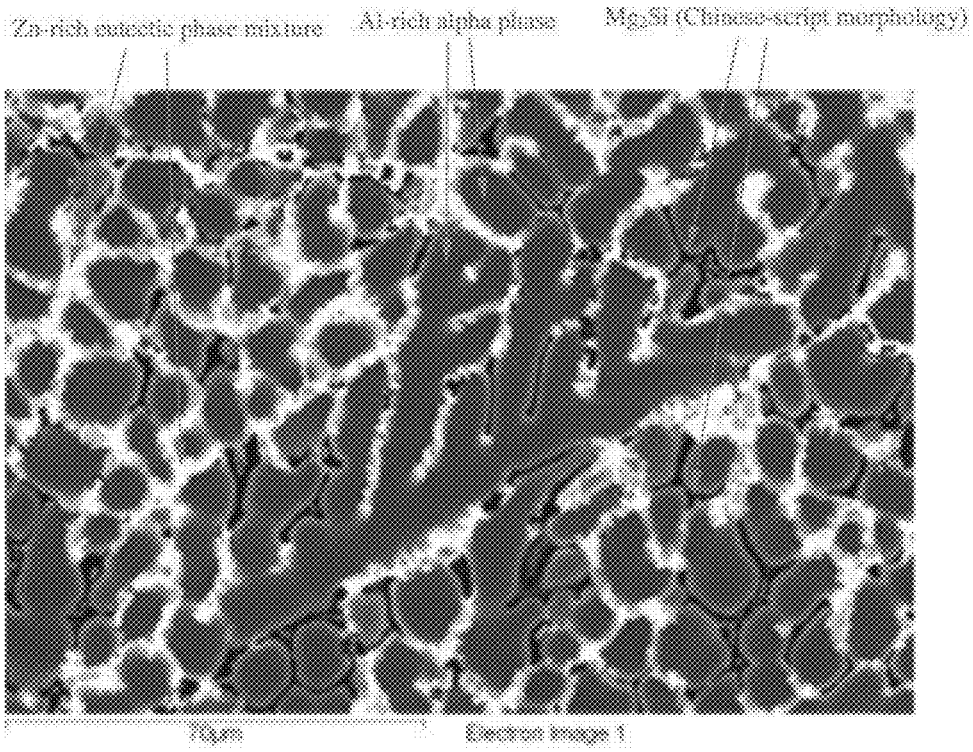
FIG. 12 is a planar view of a scanning electron microscope image of an Al—Zn—Si—Mg alloy coating in accordance with the present invention which illustrates the morphology of $Mg_2Si$ phase particles in the microstructure shown in the image.
Figure 13:
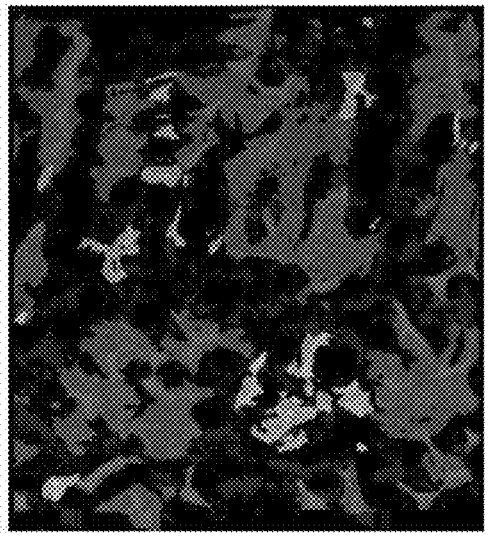
FIG. 13 is a networked 3-dimensional image of the morphology of $Mg_2Si$ phase particles in the Al—Zn—Si—Mg alloy coating of FIG. 12.

The present invention is described further with reference to the accompany drawings, of which:

FIG. 1 is a graph of edge undercutting and Mg concentration in examples of Al—Zn—Si—Mg alloy coatings in accordance with the invention on test samples in marine environments, wherein FIG. 1 shows reduction in the level of edge undercutting for painted, metallic coated steel strip in accordance with the present invention, for washed exposure in a severe marine environment;

FIGS. 2 to 4 are photographs of test panels and images of corrosion fronts that demonstrate the improved performance of examples of Al—Zn—Si—Mg alloy coatings in accordance with the invention in marine environments, wherein FIG. 2 shows improved corrosion performance for fluorocarbon painted, metallic coated steel strip in accordance with the present invention, for unwashed exposure in a severe marine environment;

FIG. 3 shows example of the extensive corrosion front for a conventional Al/Zn coating under paint in a marine environment;

FIG. 4 shows example of the more narrow and uniform corrosion front for metallic coated steel strip in accordance with the present invention, under paint in a marine environment;

FIGS. 5A-5D are photographs of laboratory accelerated test panels showing improved surface weathering and improved sacrificial protection for metallic coated steel strip in accordance with the present invention, wherein FIGS. 5A-5D show improved surface weathering but reduced level of sacrificial protection in salt spray test from an Al/Zn coating with very fine dendritic structure compared to conventional structure (B vs A), and improved surface weathering and improved sacrificial protection in salt spray test for metallic coated steel strip in accordance with the present invention compared to Al/Zn coatings with coarse or fine structure (C and D vs A and B), where FIG. 5A relates to 150 g/m$^2$ Al/Zn Coating, DAS=9 μm/OT: DAS=2, Time to 5% red rust on un-scribed surface=2435 hr;

FIG. 5B relates to 150 g/m$^2$ Al/Zn Coating, DAS=4 μm/OT: DAS=5, Time to 5% red rust on un-scribed surface =3024 hr;

FIG. 5C relates to 150 g/m$^2$ Invention Coating, DAS=8 μm/OT: DAS=2.5, Time to 5% red rust on un-scribed surface=3192 hr;

FIG. 5D relates to 150 g/m$^2$ Invention Coating DAS=3 μm/OT: DAS=6, Time to 5% red rust on un-scribed surface=4000 hr;

FIGS. 6 to 11 are photographs of test panels that demonstrate the improved performance of examples of Al—Zn—Si—Mg alloy coatings on steel strip in accordance with the present invention in "acid rain" or "polluted" environments, wherein FIG. 6 shows red rust staining on a conventional Al/Zn-based coated steel strip (total coating mass of 100 g/m$^2$ of coating), exposed in a severe "acid rain" environment for 6 months;

FIG. 7 shows no red rust staining on the Al/Zn metallic coated steel strip in accordance with the present invention (total coating mass of 100 g/m$^2$ of coating), exposed in a severe "acid rain" environment for 6 months;

FIG. 8 shows red rust staining on a conventional Al/Zn-based coated steel strip (total coating mass of 100 g/m$^2$ of coating), exposed in a severe "acid rain" environment for 18 months;

FIG. 9 shows no red rust staining on the Al/Zn metallic coated steel strip in accordance with the present invention (total coating mass of 100 g/m$^2$ of coating), exposed in a severe "acid rain" environment for 18 months;

FIG. 10 shows red rust staining on a conventional Al/Zn-based coated steel strip with columnar structure (total coating mass of 50 g/m$^2$ of coating), exposed in a severe "acid rain" environment for 4 months;

FIG. 11 shows no red rust staining on the Al/Zn metallic coated steel strip in accordance with the present invention, with columnar structure (total coating mass of 50 g/m$^2$ of coating), exposed in a severe "acid rain" environment for 4 months;

FIG. 12 is a planar view of a scanning electron microscope image of an Al—Zn—Si—Mg alloy coating in accordance with the present invention which illustrates the morphology of $Mg_2Si$ phase particles in the microstructure shown in the image; and FIG. 13 is networked 3-dimensional image of the morphology of $Mg_2Si$ phase particles in the Al—Zn—Si—Mg alloy coating of FIG. 12.

The improved corrosion performance of examples of Al—Zn—Si—Mg alloy coated steel strip in accordance with the present invention has been demonstrated by the applicant on test samples exposed in a range of actual "acid rain", "polluted" and marine environment sites.

The test samples include test panels developed by the applicant to provide information on corrosion of coatings.

FIGS. 1 to 4, FIGS. 5A-5D, and Tables 1 and 2 demonstrate the improved performance of examples of Al—Zn—Si—Mg alloy coatings on steel strip produced in accordance with the present invention in marine environments.

Performance in marine environments was assessed by outdoor exposure testing at sites with ISO ratings from C2 to C5 as per AS/NZS 1580.457.1.1996 Appendix B and by laboratory Cyclic Corrosion Testing (CCT).

Table 1 presents data that shows the improved performance in the level of painted edge undercutting of examples of Al—Zn—Si—Mg coated steel test panels in accordance with the present invention for a range of metallic coating mass (unit: mm) for washed exposure in a severe marine environment. The table also includes comparative data for conventional Al/Zn-based alloy coated test panels.

| Coating Mass | Edge Undercutting - Conventional Al/Zn Coating | Edge Undercutting - Invention Al/Zn Coating |
|---|---|---|
| 150 g/m$^2$ | 12 | 5 |
| 100 g/m$^2$ | 20 | 8 |
| 75 g/m$^2$ | 21 | 9 |
| 50 g/m$^2$ | 66 | 10 |

It is evident from Table 1 that there was significantly less edge undercutting with the Al—Zn—Si—Mg coated steel test panels in accordance with the present invention than with the conventional Al/Zn-based alloy coated test panels.

Table 2 presents further data that shows the improved performance in the level of undercutting of examples of painted Al—Zn—Si—Mg coated steel test panels in accordance with the present invention for a range of paint types (unit: mm) for washed exposure in a severe marine environment. The table also includes comparative data for conventional Al/Zn-based alloy coated test panels.

| Paint Type | Coating Mass | Edge Undercutting - Conventional Al/Zn Coating | Edge Undercutting - Invention Al/Zn Coating |
|---|---|---|---|
| Polyester | 150 g/m$^2$ | 9 | 3.5 |
| Polyester | 100 g/m$^2$ | 15 | 5 |
| Water Based | 150 g/m$^2$ | 8 | 3.2 |
| Water Based | 100 g/m$^2$ | 22 | 4.5 |
| "Cr-Free" | 150 g/m$^2$ | 22 | 6 |

It is evident from Table 2 that there was significantly less edge undercutting with the painted Al—Zn—Si—Mg coated steel test panels in accordance with the present invention that with the painted conventional Al/Zn-based alloy coated test panels.

The photographs of the test panels and the images of the corrosion fronts in FIGS. 2 to 4 further illustrate the improved performance of examples of Al—Zn—Si—Mg coatings in accordance with the present invention, in marine environments. FIG. 2 shows improved corrosion performance for fluorocarbon painted, Al—Zn—Si—Mg coatings in accordance with the present invention, for unwashed exposure in a severe marine environment. FIG. 3 is an example of an extensive corrosion front for a conventional Al/Zn coating under paint in a marine environment. FIG. 4 is an example of a narrower and more uniform corrosion front for Al—Zn—Si—Mg coatings in accordance with the present invention, under paint in a marine environment The photographs of the test panels in FIGS. 5A-5D demonstrate the improved corrosion performance of examples of Al—Zn—Si—Mg coatings in accordance with the present invention in accelerated test conditions. In particular, FIGS. 5A-5D show improved surface weathering and improved sacrificial protection of Al—Zn—Si—Mg coatings in accordance with the present invention compared to conventional Al/Zn coatings with coarse or fine structure in a salt fog Cyclic Corrosion and Test.

FIGS. 6 to 11 demonstrate the improved performance of Al—Zn—Si—Mg coated steel test panels in "acid rain" or "polluted" environments when produced in accordance with the present invention. The photographs show red rust staining on conventional Al/Zn-based alloy coated steel test panels and no red rust staining on the Al—Zn—Si—Mg coated steel test panels manufactured in accordance with the present invention. Comparison of FIG. 9 with FIG. 7 shows that the benefit is retained over time. In particular, FIG. 6 shows red rust staining on a conventional Al/Zn-based coated steel strip (total coating mass of 100 g/m$^2$ of coating) exposed in a severe "acid rain" environment for 6 months. FIG. 7 shows that there was no red rust staining on an Al—Zn—Si—Mg coating in accordance with the present invention (total coating mass of 100 g/m$^2$ of coating), exposed in a severe "acid rain" environment for 6 months. FIG. 8 shows red rust staining on a conventional Al/Zn-based coated steel strip (total coating mass of 100 g/m$^2$ of coating), exposed in a severe "acid rain" environment for 18 months. FIG. 9 shows that there was no red rust staining on an Al—Zn—Si—Mg coating in accordance with the present invention (total coating mass of 100 g/m$^2$ of coating), exposed in a severe "acid rain" environment for 18 months. FIG. 10 shows that there was red rust staining on a conventional Al/Zn-based coated steel strip with columnar structure (total coating mass of 50 g/m$^2$ of coating), exposed in a severe "acid rain" environment for 4 months. FIG. 11 shows that there was no red rust staining on an Al—Zn—Si—Mg coating in accordance with the present invention, with columnar structure (total coating mass of 50 g/m$^2$ of coating), exposed in a severe "acid rain" environment for 4 months.

Finally, the applicant found in microstructural analysis of examples of Al—Zn—Si—Mg coatings in accordance with the present invention that the microstructure includes $Mg_2Si$ phase particles of a particular morphology in the interdendritic channels of Zn-rich eutectic phase mixture that are between dendrites of Al-rich alpha phase and this morphology is important in improving the corrosion resistance of the coatings, as discussed above. The applicant found that the size and distribution of the $Mg_2Si$ phase particles are also important factors contributing to the improved corrosion performance of the Al—Zn—Si—Mg coatings in accordance with the present invention. The applicant also found that desirable morphology, size and distribution of $Mg_2Si$ phase particles were possible by selection of coating compositions and control of cooling rates during coating solidification.

FIGS. 12 and 13 illustrate one example of the morphology of $Mg_2Si$ phase particles discussed above.

In the planar image of FIG. 12, the darker regions are Al-rich alpha phase dendrites, the bright regions are interdendritic channels with Zn-rich eutectic phase mixture, and the "chinese-script" $Mg_2Si$ phase particles that partially fill the channels.

In the 3-dimensional image of FIG. 13, the $Mg_2Si$ "petals" are shown by the red colour and the other phases include: Si (green), $MgZn_2$ (blue) and Al-rich alpha phase (dark matrix).

Many modifications may be made to the present invention described above without departing from the spirit and scope of the invention.

What is claimed is:

1. A coated metal strip with a corrosion resistant coating of an Al—Zn—Si—Mg alloy on one or both surfaces of the metal strip, wherein the coating comprises
- 40-65 wt. % Al,
- 35-50 wt. % Zn,
- 1-3 wt. % Si,
- 1.5-2.5 wt. % Mg, and
- optionally other elements in amounts of less than 0.5 wt. % for each other element;
- the coating having
- an overlay thickness greater than 5 μm and less than 30 μm; and
- a microstructure comprising
  - dendrites of Al-rich alpha phase,
  - interdendritic channels of Zn-rich eutectic phase mixture extending from the metal strip, and
  - $Mg_2Si$ phase particles in greater than 60% of the interdendritic channels, wherein the $Mg_2Si$ phase particles in the interdendritic channels block corrosion along the interdendritic channels.

2. The coated metal strip defined in claim 1 wherein greater than 70% of the total volume fraction of $Mg_2Si$ phase in the coating is in the lower two thirds of the overlay thickness of the coating.

3. The coated metal strip defined in claim 1 wherein the $Mg_2Si$ phase particles in the interdendritic channels have a size range and a spacial distribution that activates the Al-rich alpha phase to provide sacrificial protection.

4. The coated metal strip defined in claim 1 wherein greater than 70% of the interdendritic channels are blocked by $Mg_2Si$ phase particles.

5. The coated metal strip defined in claim 1 wherein the overlay thickness of the coating is less than 20 μm.

6. The coated metal strip defined in claim 1 wherein the Zn concentration is 39-48 wt. %.

7. The coated metal strip defined in claim 1 wherein the Mg concentration is 1.7-2.3 wt. %.

8. The coated metal strip defined in claim 1 wherein the Si concentration is 1.3-2.5 wt. %.

9. The coated metal strip defined in claim 1 wherein the metal strip is a steel strip.

* * * * *